US005746492A

United States Patent [19]

Tai

[11] Patent Number: 5,746,492

[45] Date of Patent: May 5, 1998

[54] EMERGENCY LIGHT HAVING SMOKE PROOF MASK

[76] Inventor: Tzu Hsiung Tai, No. 137, San Hsien St., Taichung, Taiwan

[21] Appl. No.: 785,010

[22] Filed: Jan. 17, 1997

[51] Int. Cl.[6] ..... F21V 23/00; F21V 33/00; F21L 15/14

[52] U.S. Cl. ..... 362/20; 362/105; 362/253; 362/802; 128/202.13; 128/206.12; 128/206.27

[58] Field of Search ..... 362/105, 253, 362/200, 202, 207, 20, 86, 802; 128/206.27, 202.13, 206.12

[56] References Cited

U.S. PATENT DOCUMENTS

| | | | |
|---|---|---|---|
| 2,893,344 | 7/1959 | Meyers | 116/112 |
| 3,171,109 | 2/1965 | Appel | 340/586 |
| 3,591,796 | 7/1971 | Barker | 362/20 |
| 3,812,847 | 5/1974 | Moore et al. . | |
| 4,177,500 | 12/1979 | Nicholl et al. | 362/20 |
| 4,368,507 | 1/1983 | Reynolds | 362/200 |
| 4,631,649 | 12/1986 | McCue et al. | 362/183 |
| 4,638,410 | 1/1987 | Barker | 362/105 |
| 4,640,278 | 2/1987 | Barry | 128/206.12 |
| 4,682,078 | 7/1987 | Pascalide | 315/86 |
| 4,703,402 | 10/1987 | Hsieh | 362/102 |
| 4,835,665 | 5/1989 | Kao | 362/184 |
| 4,905,684 | 3/1990 | Heffer | 128/202.13 |
| 4,949,077 | 8/1990 | Mbuthia | 340/628 |
| 5,055,986 | 10/1991 | Johnson | 362/253 |
| 5,109,322 | 4/1992 | Loughlin | 362/109 |
| 5,119,280 | 6/1992 | Yang | 362/191 |
| 5,154,600 | 10/1992 | Sylvestre | 431/253 |
| 5,318,177 | 6/1994 | Isacson | 206/38.1 |
| 5,325,279 | 6/1994 | Freelove et al. | 362/145 |
| 5,483,956 | 1/1996 | Shapiro | 128/206.27 |
| 5,530,631 | 6/1996 | Smith et al. | 362/105 |
| 5,553,606 | 9/1996 | Chen | 128/202.13 |
| 5,564,128 | 10/1996 | Richardson | 1/422 |
| 5,580,157 | 12/1996 | Patricca et al. | 362/191 |

FOREIGN PATENT DOCUMENTS

| | | | |
|---|---|---|---|
| 2 110 359 | 6/1983 | United Kingdom | 362/253 |

*Primary Examiner*—Ira S. Lazarus
*Assistant Examiner*—Ljiljana V. Ciric
*Attorney, Agent, or Firm*—Charles E. Baxley, Esq.

[57] ABSTRACT

An emergency light includes a housing having a lamp and having also a battery for energizing the lamp. A smoke-proof mask is disposed in the housing and includes a filter for filtering smoke and means for allowing user the to find the mask easily and quickly. A buzzer may be coupled to the battery for indicating to a blind user where to find the smoke-proof mask easily and quickly. The battery is a rechargeable battery and is coupled to a sensing/switching circuit which may switch the battery to energize the lamp when the AC power supply is not supplied to the sensing/switching circuit.

4 Claims, 2 Drawing Sheets

EMERGENCY LIGHT HAVING SMOKE PROOF MASK

BACKGROUND OF THE INVENTION

1. Field of the Invention

The present invention relates to an emergency light, and more particularly to an emergency light having a smoke-proof mask.

2. Description of the Prior Art

Typical emergency lights are used for lighting purposes in the dark, particularly in a dark room during a fire. However, in most fires, the wounded or dead persons are not harmed by the fire but by the smoke generated in the fire. The frightened and worried persons may not find suitable masks for covering their noses. Particularly, most of the persons on the upper floors of a building and in the smoke cover their noses with a wet towel with one hand such that they have only one hand left for finding the way out.

The present invention has been developed to mitigate and/or obviate the afore-described disadvantages of conventional emergency lights and masks.

SUMMARY OF THE INVENTION

The primary objective of the present invention is to provide an emergency light having a smoke-proof mask with means for allowing people to find the mask easily and for preventing them from being hurt by the smoke.

In accordance with one aspect of the invention, there is provided a light combination comprising a housing including a chamber, a lamp secured to the housing, at least one battery secured in the housing and coupled to the lamp for energizing the lamp, and a smoke-proof mask disposed in the chamber of the housing for allowing a user to find the mask easily.

The smoke-proof mask includes a filter for filtering smoke and also includes a mask body coupled to the filter.

A fastening member may secure the filter to the housing, and a fastener belt may attach the smoke-proof mask to the user. A buzzer may be coupled to the battery for indicating to a blind user where to find the smoke-proof mask easily and quickly.

The battery and is a rechargeable battery, the light combination further comprises an electric board secured in the housing and including a charge circuit coupled to the rechargeable battery for charging the rechargeable battery, a sensing/switching circuit coupled to the lamp and coupled to the rechargeable battery and coupled to the charge circuit for sensing a power supply to the sensing/switching circuit and for switching and coupling the rechargeable battery to the lamp and for energizing the lamp when the power supply is not being supplied to the sensing/switching circuit.

Further objectives and advantages of the present invention will become apparent from a careful reading of the detailed description provided hereinbelow, with appropriate reference to accompanying drawings.

DETAILED DESCRIPTION OF THE PREFERRED EMBODIMENT

Figure 1:
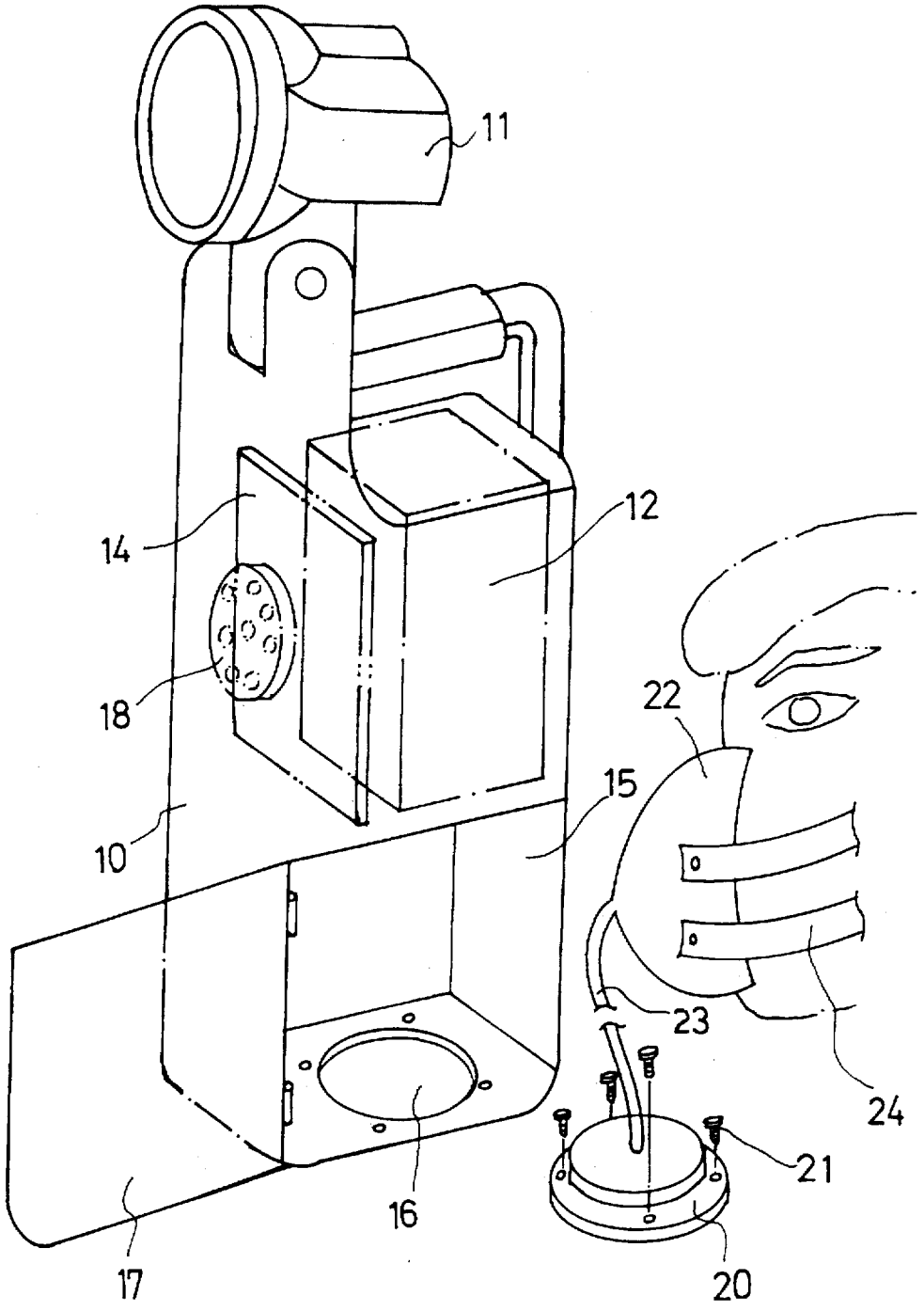
FIG. 1 is a partial exploded view of an emergency light in accordance with the present invention.

Referring to the drawings, and initially to FIG. 1, an emergency light in accordance with the present invention comprises a housing 10 including a lamp 11 which is preferably pivotally secured on the housing 10 at a pivot shaft for allowing the lamp 11 to be rotated about the pivot shaft. One or more batteries 12 are disposed in the housing 10 and coupled to the lamp 11 for energizing the lamp 11. A circuit board 14 is secured in the housing 10 and a speaker or a buzzer 18 is secured to the circuit board 14. The housing 10 includes a chamber 15 formed in the bottom portion and a cap 17 pivotally coupled to the housing 10 for covering the chamber 15. An opening 16 is formed in the bottom of the housing 10. A filter 20 for filtering smoke is secured in the chamber 15 by fastening members 21 and is coupled to a mask 22 by a hose 23. The filter 20 is communication with the opening 16 for allowing air to flow into the mask 22 via the filter 20. Instead, the mask 22 itself may be made as a smoke-proof mask 22 for preventing people from being hurt by the smoke. A fastener belt 24 is secured to the mask 22 for allowing the mask 22 to be engaged onto the head of the user and for allowing the user to use his both hands free for finding the way out of the smoke.

Figure 2:
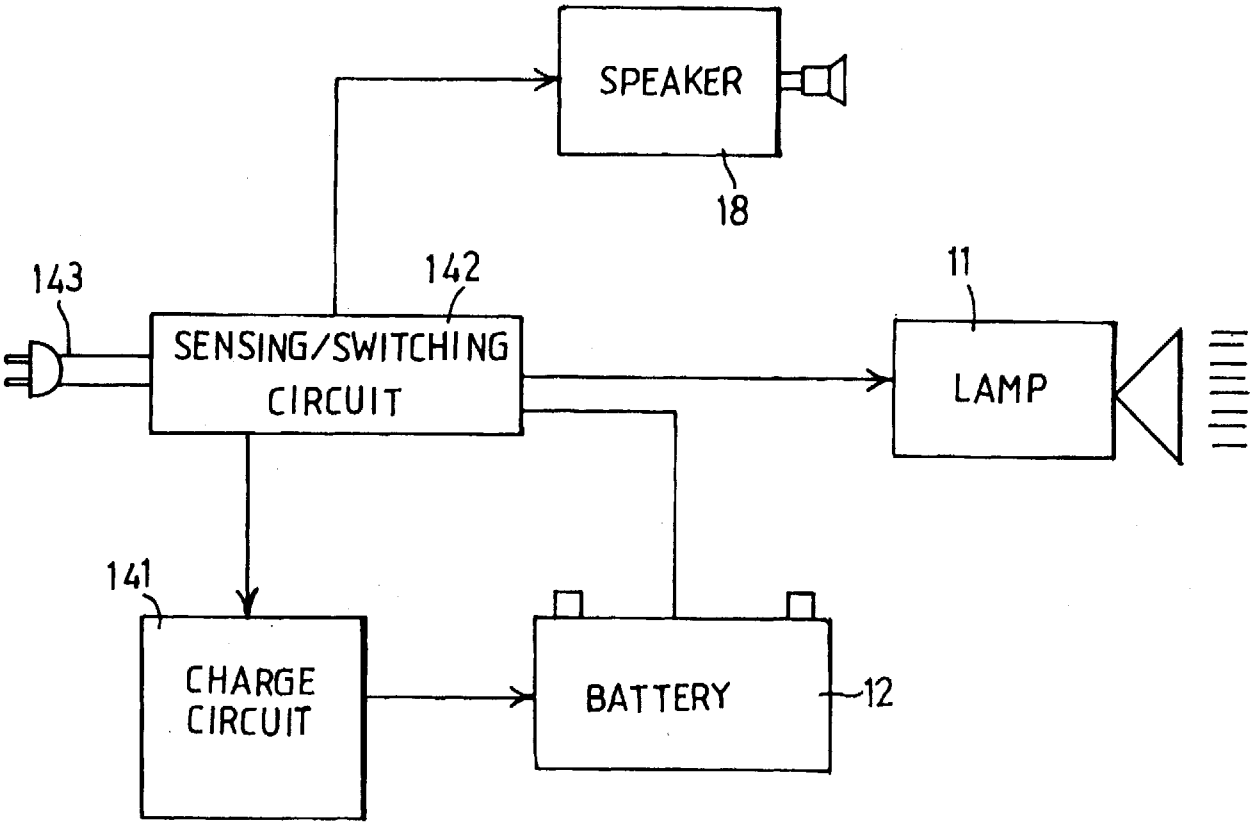
FIG. 2 is a block diagram illustrating one exemplary circuit of the emergency light.

As shown in FIG. 2, the battery 12 is preferably a rechargeable battery and is coupled to a charge circuit 141 for being charged by the charge circuit 141. A sensing/switching circuit 142 is provided and coupled to the lamp 11, to the buzzer 18, to the battery 12 and to the charge circuit 141. The sensing/switching circuit 142 is normally coupled to a power supply 143, particularly an alternating current (AC) power supply, and is provided for sensing whether the power supply 143 has been cut off or not. The lamp 11 is not energized when the power supply 143 is supplied to the sensing/switching circuit 142. However, when the power supply is cut off and is not being supplied to the sensing/switching circuit 142, particularly during a fire, the sensing/switching circuit 142 may switch and couple the battery 12 to the lamp 11 for energizing the lamp 11.

In operation, during a fire and when the power supply 143 is cut off and is not supplied being to the emergency light, the sensing/switching circuit 142 may switch and couple the battery 12 to the lamp 11 for energizing the lamp 11 such that the user may easily find the mask 22. The filter 20 and/or the smoke-proof mask 22 may be secured to the housing 10 and may be prevented by fastening members 21 from being separated from the housing 10 by the fastening members 21 during an emergency condition. Alternately, the filter 20 and/or the mask 22 may be secured to the housing 10 by other securing members, such as a hook and loop device for allowing the filter 20 to be easily separated from the housing 10 easily when the light from lamp 11 is not necessary. The fastener belt 24 may attach the mask 22 to the head of the user to allow the user to use both hands for finding the way out of the fire. The buzzer 18 may be energized for altering blind people and for allowing blind people to find the mask easily and quickly when the power supply 143 is not being supplied to the emergency light.

Accordingly, the emergency light in accordance with the present invention includes a smoke-proof mask having means for allowing people to find the mask easily and for preventing people from being hurt by the smoke.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A light combination comprising:

a portable housing including a chamber, a lamp pivotally secured to said housing, at least one battery secured in said housing and coupled to said lamp for energizing said lamp, a smoke-proof mask disposed in said chamber of said housing for allowing a user to find the mask easily, said smoke-proof mask including a filter for filtering smoke and including a mask body coupled to said filter, and means for securing said filter directly to said on an inside surface of said chamber housing.

2. A light combination according to claim 1 further comprising means for attaching said smoke proof mask to the user.

3. A light combination according to claim 1 further comprising a buzzer coupled to said battery for allowing said buzzer to a blind user where and to indicate to the blind user to find the smoke-proof mask.

4. A light combination according to claim 1, wherein said battery is a rechargeable battery, said light combination further a charge circuit coupled to said rechargeable battery for charging said rechargeable battery, a sensing/switching circuit coupled to a power supply and also coupled to said rechargeable battery and to said charge circuit, said rechargeable battery and said lamp being coupled to said sensing/switching circuit, said sensing/switching circuit being coupled between said power supply and said charge circuit for sensing the power supply to said sensing/switching circuit and for switching and coupling said rechargeable battery to said lamp and for energizing said lamp when the power supply is not supplied to said sensing/switching circuit.

* * * * *